US007913476B2

(12) United States Patent
Lachenmeier

(10) Patent No.: US 7,913,476 B2
(45) Date of Patent: Mar. 29, 2011

(54) WRAPPING DEVICE, DETENT MECHANISM FOR SAID WRAPPING DEVICE AND METHOD FOR OPERATION THEREOF

(75) Inventor: Per Lachenmeier, Sonderborg (DK)

(73) Assignee: Illinois Tool Works Inc., Glenview, IL (US)

( * ) Notice: Subject to any disclaimer, the term of this patent is extended or adjusted under 35 U.S.C. 154(b) by 83 days.

(21) Appl. No.: 12/440,090

(22) PCT Filed: Sep. 15, 2006

(86) PCT No.: PCT/EP2006/009023

§ 371 (c)(1), (2), (4) Date: Mar. 5, 2009

(87) PCT Pub. No.: WO2008/031449

PCT Pub. Date: Mar. 20, 2008

(65) Prior Publication Data

US 2009/0272080 A1 Nov. 5, 2009

(51) Int. Cl.
*B65B 9/13* (2006.01)
*B65B 59/04* (2006.01)

(52) U.S. Cl. ..... 53/441; 53/459; 53/556; 53/567; 53/393

(58) Field of Classification Search ..... 53/441, 53/459, 556, 567, 588, 393; *B65B 9/13, B65B 59/04*

See application file for complete search history.

(56) References Cited

U.S. PATENT DOCUMENTS

| | | | | |
|---|---|---|---|---|
| 3,823,527 | A * | 7/1974 | Burn | 53/567 |
| 3,961,459 | A * | 6/1976 | Wolske | 53/441 |
| 4,050,219 | A * | 9/1977 | Higgins | 53/567 |
| 4,745,726 | A * | 5/1988 | Rosenthal et al. | 53/556 |
| 5,155,970 | A * | 10/1992 | Moore | 53/441 |
| 5,517,807 | A * | 5/1996 | Morantz | 53/556 |
| 5,836,538 | A * | 11/1998 | Lencoski et al. | 242/559.1 |
| 6,381,929 | B1 * | 5/2002 | Chen | 53/567 |
| 7,036,289 | B2 * | 5/2006 | Suolahti | 53/556 |

FOREIGN PATENT DOCUMENTS

| | | |
|---|---|---|
| DE | 3234929 | 3/1984 |
| DE | 93000666 | 6/1993 |
| DE | 19819488 | 11/1999 |

OTHER PUBLICATIONS

International Search Report for PCT/EP2006/009023, mailed May 2, 2007, 10 pages.

* cited by examiner

*Primary Examiner* — Stephen F Gerrity
(74) *Attorney, Agent, or Firm* — Levenfeld Pearlstein, LLC

(57) ABSTRACT

A wrapping device 1 for packaging goods, specifically goods stacked on pallets or the like, with a tube-like film, with a film feeding device 4 with fusion and cutting systems to generate and feed a dome-like film cover within a device frame 6, where film feeding device 4 works in conjunction with a covering device 7 that moves vertically up and down within device frame 6, where covering device 7 is designed to grasp the film cover and place it to cover goods located in the lower segment of device frame 6, is characterized by having film feeding device 4 move vertically within device frame 6. This arrangement simplifies installation, maintenance and repairs, specifically to the film feeding device.

7 Claims, 14 Drawing Sheets

Figure 1:
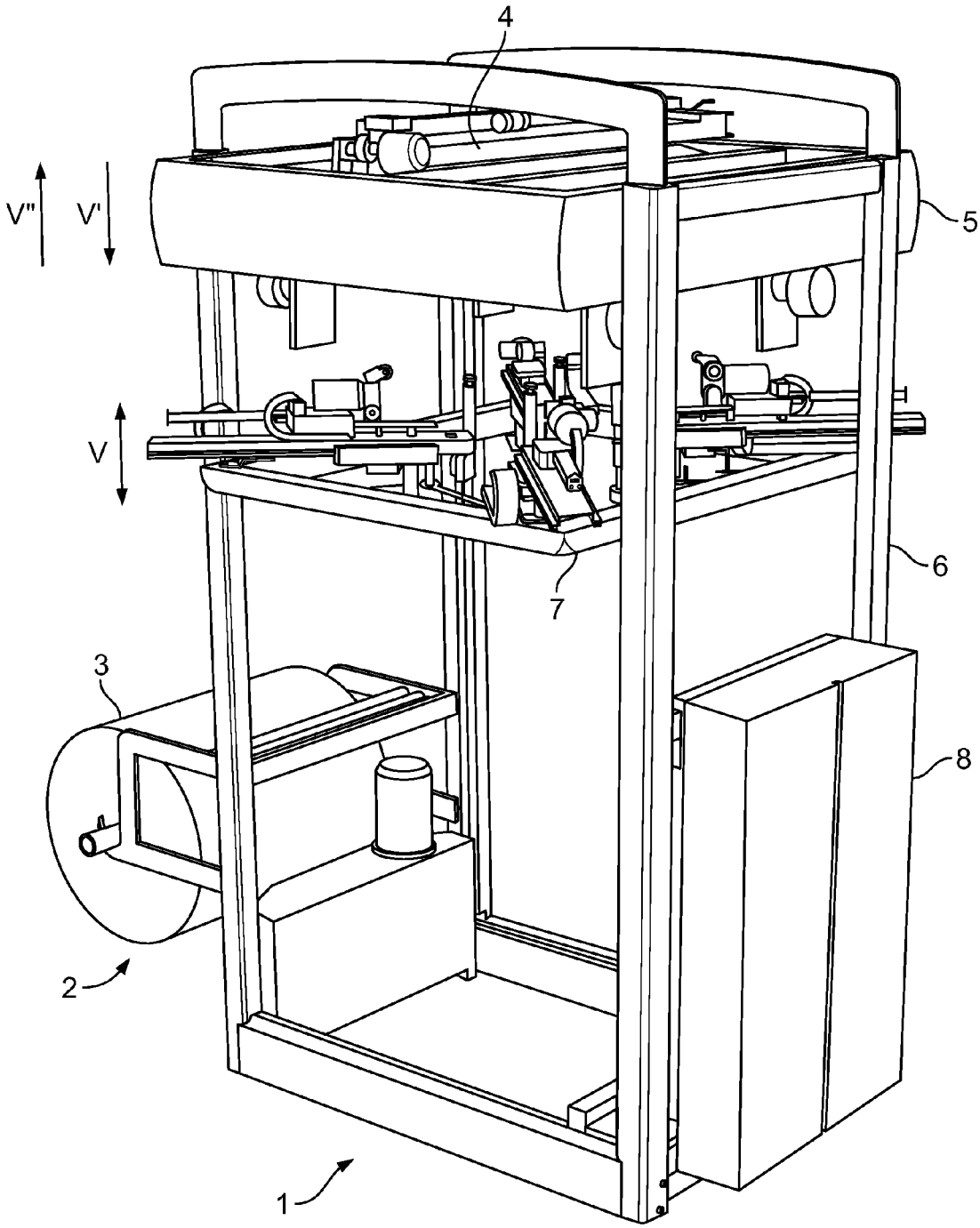

WRAPPING DEVICE, DETENT MECHANISM FOR SAID WRAPPING DEVICE AND METHOD FOR OPERATION THEREOF

The invention concerns a wrapping device for the packaging of goods, specifically goods stacked on pallets or the like, with a tube-like film, which includes a film feeding device with fusion and cutting systems to produce and feed a domed film cover within a frame and which works in conjunction with a covering device that moves vertically up and down within the frame, where the covering device grasps the film cover and pulls it over goods positioned in a lower segment of the frame.

Furthermore, the invention concerns a detent mechanism for a wrapping device and a process to operate the same.

Processes and devices to wrap goods by means of a tube-like film are known from the state of the arts. For example, wrapping devices of the type identified above normally include a film feeding device with fusion and cutting systems and a covering device, where the film feeding device and the fusion and cutting systems are attached in a fixed manner within the frame above the covering device. The film feeding device feeds a segment of a tube-like film from the film supply roll, which is then fused into a film cover or film dome and is separated above the fusion line. The covering device then grasps the film dome thus produced, opens it and moves downwards with the same within the frame, such that the film dome is pulled over the goods located in the lower segment of the frame to cover them.

The known wrapping devices of the type identified above are designed to include stairs on the exterior of the frame that lead to a maintenance or service platform on the upper end of the device. Stairs are needed in the wrapping devices known from the state of the arts to provide maintenance staff with access to the film feeding device and its fusion and cutting systems that are affixed to the upper segment of the device. They are used in maintenance and service work, such as replacement of knives or fusion wires, maintenance, replacement of film or the like.

To simplify the terms, the film feeding device and its fusion and cutting systems will be referenced hereinafter in short as "film feeding device". It will include in each case the aforementioned fusion and cutting systems.

It must be viewed as disadvantageous that the design of stairs and a corresponding platform in the upper segment of the wrapping device implies that previously known devices will be more expensive to purchase. Given that the aforementioned maintenance and repair work will also need to be done at great height above the device, overall more disadvantageous working conditions with corresponding safety constraints will result.

The invention responds to the objective of further development of a wrapping device of the type described above such that maintenance or repairs of the wrapping device are simplified and to specify a process to its operation. At the same time, the purchase price of the wrapping device is to be reduced and the operating and maintenance safety are to be improved.

The objective is solved by a first aspect of the present invention for a wrapping device of the type described above, where the film feeding device is designed to move vertically within the frame.

A second aspect of the present invention solves the objective specified above by means of a detent mechanism for the vertical fixation of a film feeding device with fusion and cutting systems that can move vertically within a frame, specifically for the wrapping device proposed by this invention, where the detent mechanism contains a toggle lever that rotates around a first rotation axis perpendicular to the vertical direction of movement of the film feeding device and that includes an inner detent notch facing the film feeding device. The ramp segment of the toggle switch is shaped to match a complementary latch on the film feeding device such that a vertical rising movement of the film feeding device causes the toggle lever to rotate to the outside until the latch snaps into the detent notch to prevent the film feeding device from moving downwards.

A third aspect of the present invention solves the objective specified above by a process to operate the wrapping device of the invention, specifically by use of the detent mechanism specified above, where the film feeding device is moved within the frame into a raised operating position and is locked in that position, and where the film feeding device is lowered to a lower position within the frame for access to the film feeding device, for example, for maintenance purposes.

In accordance with the basic idea underlying the present invention, it is thus feasible to lower the film feeding device within the device frame. Consequently, the maintenance and repair work may be handled in a comfortable position and at a low height. The stairs and maintenance platform required for the devices in the state of the arts are thus not needed. Rather, a maintenance worker can handle the maintenance or repairs of the film feeding device comfortably while standing at ground level. Once the maintenance or repair has been completed, the film feeding device may be returned into the desired operating position in the upper part of the wrapping device. Thus, the costs of the device according to the invention will be reduced by the savings due to the omission of the stairs and the maintenance platform. In addition, operating and maintenance safety is improved.

A further embodiment of the wrapping device of the invention may design the film feeding device such that it is affixed to a frame that moves vertically within the device frame. Thus, movement of the frame may facilitate a lowering of the film feeding device within the device frame.

Another embodiment of the wrapping device of the invention is designed to move the film feeding device between a raised operating position and a lowered maintenance position. Thus, such an embodiment of the device of the invention is characterized by two positions of the movable film feeding device, specifically a first raised operating position, preferably at the upper end of the device frame, and a second maintenance or repair position at the lower end of the device frame and possibly above a transport unit included there for the insertion or removal of goods. The film feeding device can be moved between these two positions.

In this context, another embodiment of the wrapping device of the invention may be designed to include at least one locking mechanism to hold the film feeding device in a particular position on the device frame. Specifically, an embodiment of the wrapping device of the invention may thus include a locking mechanism to hold the film feeding device or the frame in the raised operating position on the device frame. The locking mechanism may be released or locked automatically or by remote control to lock the film feeding device in the raised position or to release it from the same.

Another embodiment of the wrapping device of the invention may integrate at least one locking mechanism to lock the film feeding device into the device frame itself.

In order to provide for another improvement of the wrapping device of the invention, the design may also include at least one detent mechanism within the locking mechanism to hold the film feeding device in the appropriate position (operating position) that is triggered by a vertical movement of the covering device in contact between the covering device and the film feeding device to move the film feeding device. In other words: The covering device, which is present in wrapping devices of this type and which moves vertically, may be moved upwards against the film feeding device or the movable frame housing the same and triggers the detent mechanism on contact, such that a subsequent movement of the film feeding device is also possible. The latter is thus designed to be purely passive with regard to vertical movement in an embodiment of the object of the invention, i.e. it includes no separate means of propulsion, which lowers its cost. However, as an alternative, it is feasible to include an appropriate motor for the independent vertical movement of the film feeding device, which makes the same independent of the covering device and yields corresponding time savings during vertical movement.

Another embodiment of the wrapping device of the invention may include a number of alternative operating positions of the film feeding device along the vertical frame of the wrapping device. Each of these operating positions may have at least one locking mechanism to hold the film feeding device in that position and/or at least one detent mechanism as described above. The various locking mechanisms or detent mechanisms are situated respectively on various heights or height levels within the frame of the device.

Such an embodiment of the wrapping device of the invention makes it feasible, particularly for palletized goods to be wrapped that are not very high, to support the film feeding device and the covering device merely a short distance above the goods to be wrapped in an appropriate operating position in order to minimize the travel distance of the covering device, which needs to move in each wrapping operation from the current operating position of the film feeding device to its lowest position at the lowest end of the goods to be wrapped. In the embodiment of the wrapping device of the invention described above, the covering device will thus move only a minimal distance corresponding essentially to the height of the object to be wrapped. This yields the particular advantage of significantly increasing the speed of the wrapping device of the invention, given that the operating movement of the covering device may be adjusted to match the height of the object to be wrapped exactly, such that the covering device does not need to be raised to the highest operating position to accept the film cover from the film feeding device. This will significantly increase the efficiency and output of the wrapping device of the invention, while reducing wear and tear and thus costs.

An additional advantageous embodiment of the wrapping device of the invention designs the upper portion of the device frame to be removable. This is facilitated in the invention by having the covering device and the film feeding device movable vertically in a lower segment of the device frame. Once the upper segment of the device frame has been removed, movement of the device, for example, will thus require less space. Furthermore, such a design also facilitates improved access to the vertically movable components of the wrapping device during maintenance, particularly to the film feeding device and the covering device. In addition, the removal or replacement of these vertically movable components is simplified. They can be installed easily in the "down" position and can then be raised to their respective operating positions once the upper segment has been mounted.

The processes of locking the vertically movable film feeding device into position or releasing it are only made feasible or significantly simplified by the inclusion of a detent mechanism as described in this invention, which is intended to lock the film feeding device into position in a controllable manner.

In order to keep the detent mechanism normally in an activated position or operating position, a first embodiment may be designed to put pressure on the toggle lever of the detent mechanism of the invention in the direction of the film feeding device by use of springs, hydraulic means or pneumatic means, for example.

A mentioned above, in order to release the film feeding device from below from a fixed position by contact with the covering device, another embodiment of the detent mechanism of the invention provides that the free end of the toggle lever opposite the first rotation axis works via a contact element in conjunction with a rotating lever that rotates around a second rotation axis parallel to the first rotation axis such that movement of the toggle lever causes movement of the rotating lever, where the rotating lever has a notch formed such that vertical movement upwards of the film feeding device beyond the detent position pushes the contact element of the toggle lever into the notch, where the rotating lever blocks the toggle lever in a maximum rotation position in which a free vertical movement of the film feeding device is facilitated. Once the toggle lever is blocked, unimpeded travel of the film feeding device past the detent mechanism in a vertical downward direction is thus facilitated.

In order to reactivate the detent mechanism after sufficient downward movement of the film feeding mechanism beyond the securing zone of the detent mechanism, an additional embodiment of the detent mechanism of the invention is designed with a projection relative to the second rotation axis on the rotating lever in the maximum rotation position of the toggle lever that extends towards the film feeding device, such that downward movement of the film feeding device beyond the detent position causes the detent latch to make contact with the projection on the rotating lever to rotate the rotating lever and release the toggle lever from the notch on the rotating lever.

The listed embodiments of the detent mechanism of the invention are thus designed to permit the film feeding device to traverse them in an upward or downward direction without interference, i.e. without locking the same into position permanently. However, to reduce wear and tear, a further embodiment of the invention provides for at least a part of the detent mechanism to move horizontally relative to the film feeding device between a first inner operating position and a second outer stand-by position, where there is no interaction between the latch and the toggle lever and/or the rotating lever during vertical movement of the film feeding device in the second position. Given the fact that that there is no mechanical interaction between the film feeding device and the detent mechanism in its stand-by position, wear and tear will be reduced significantly as a result.

Figure 2:
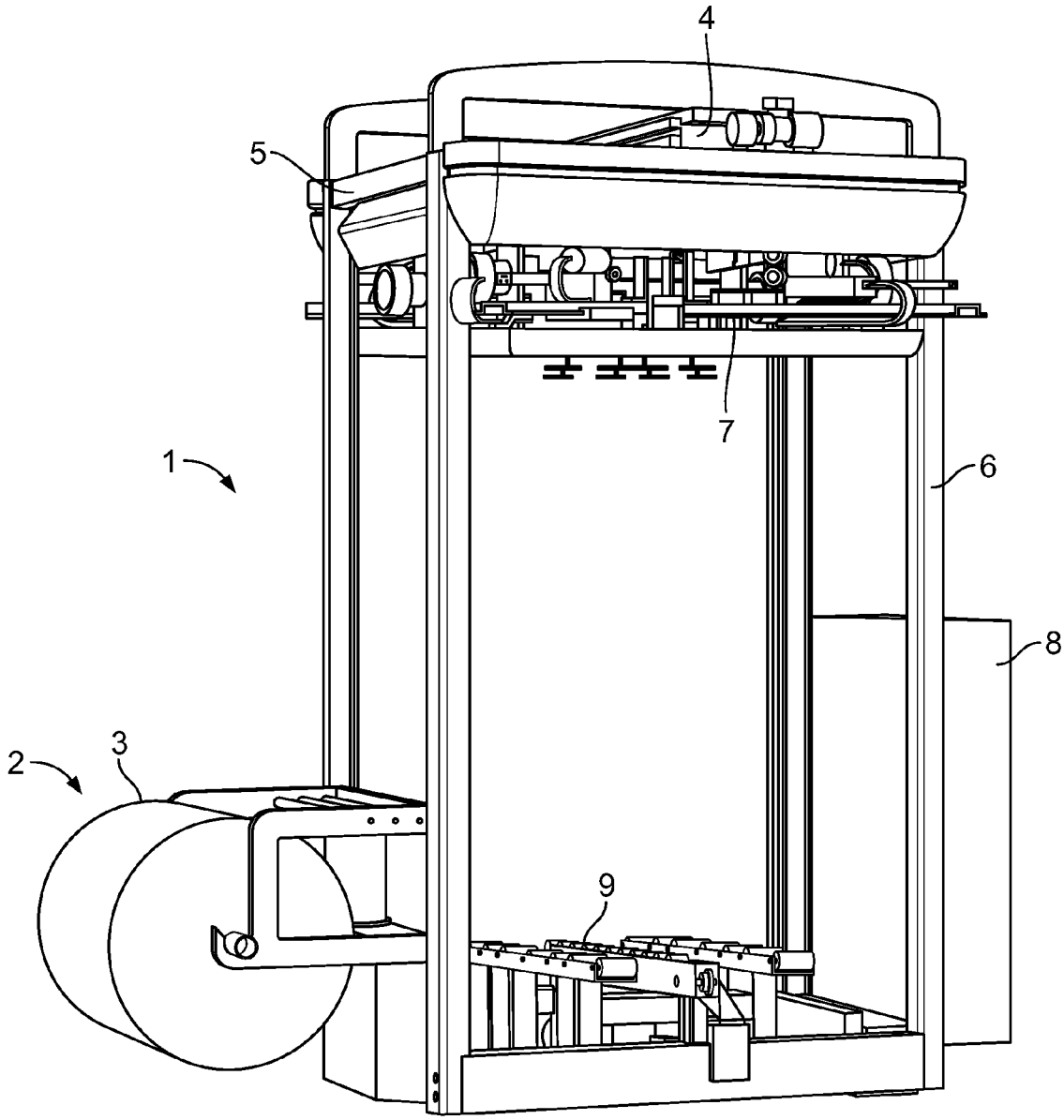
Figure 3:
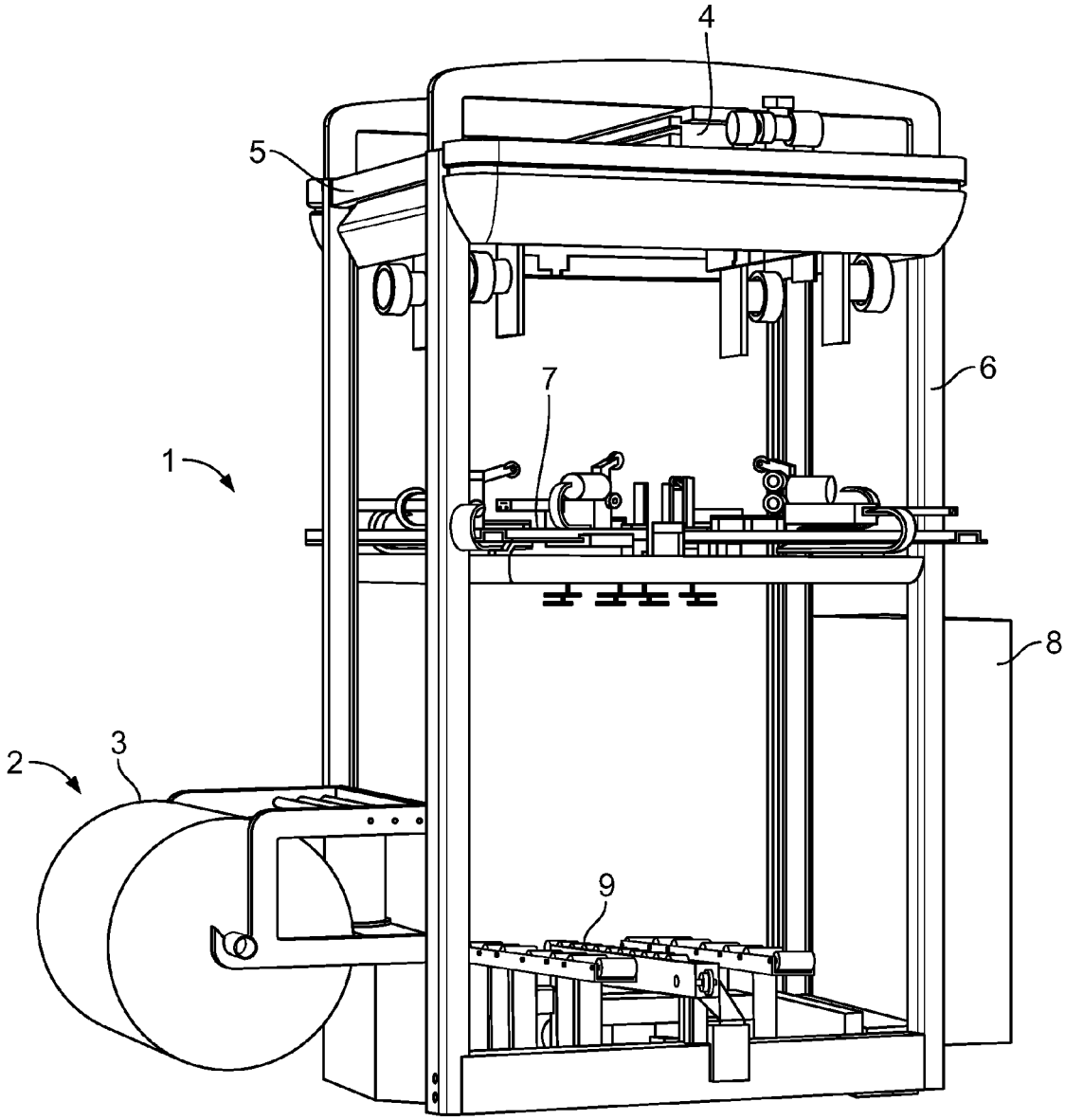
Figure 4:
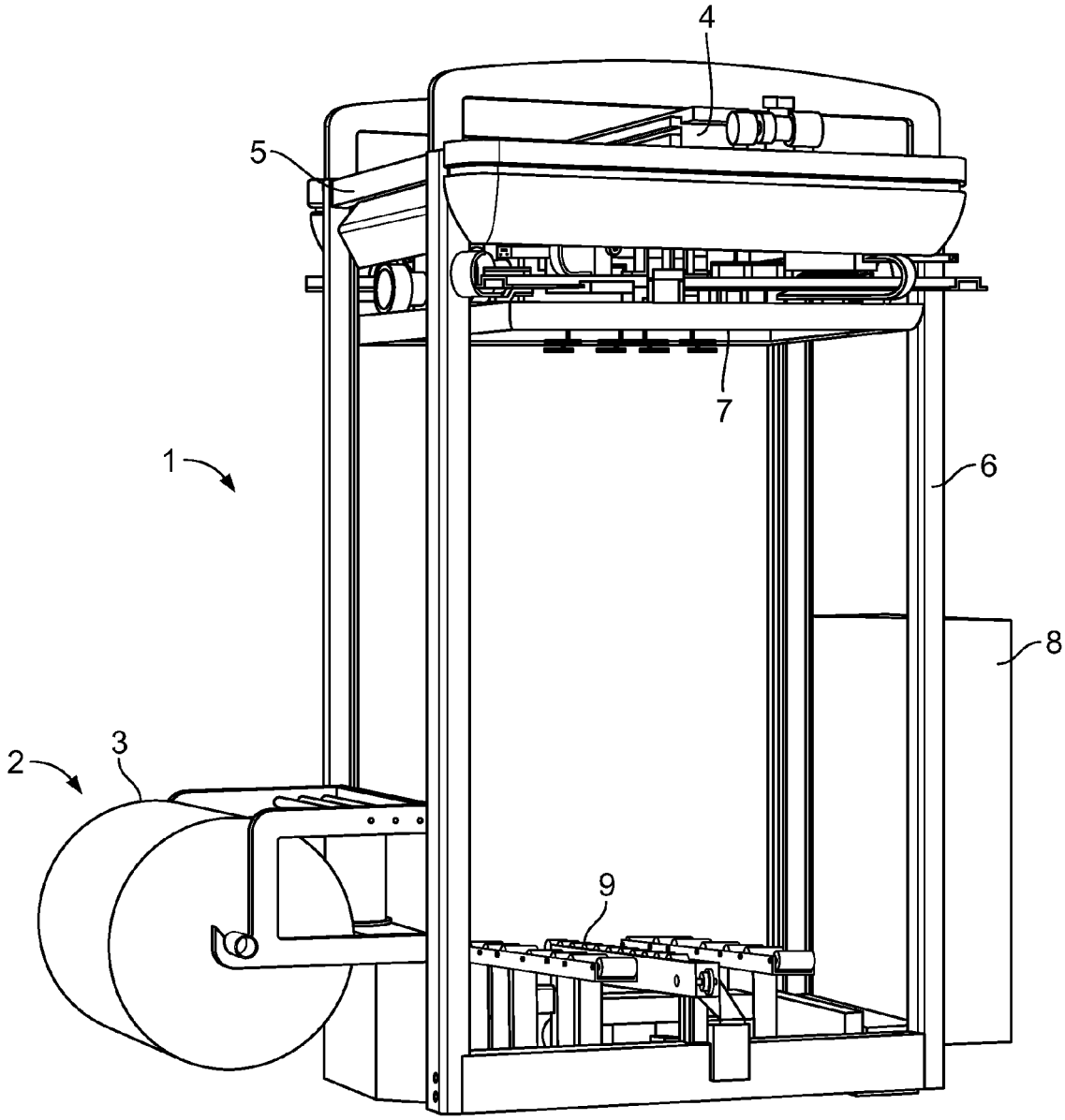
Figure 5:
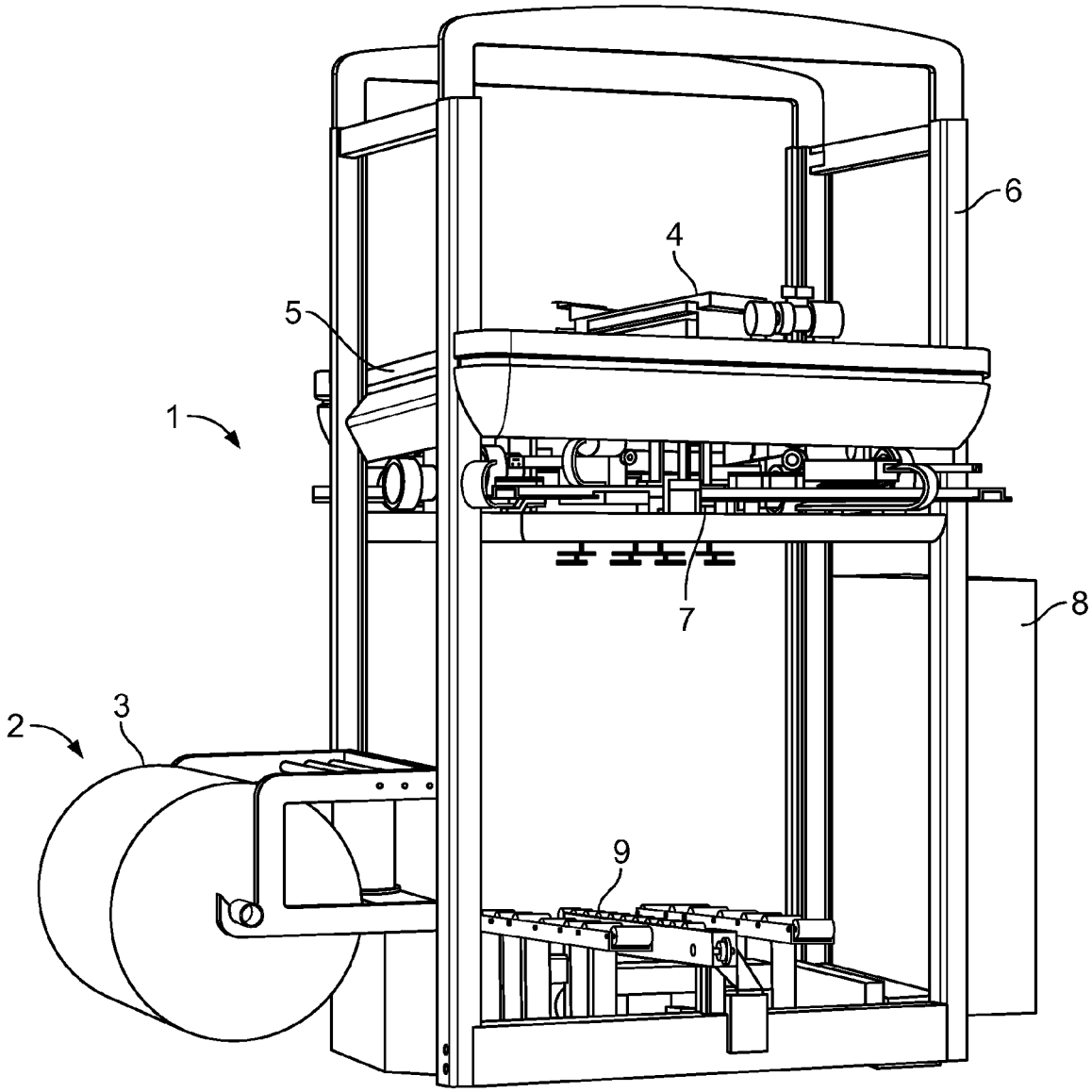
Figure 6:
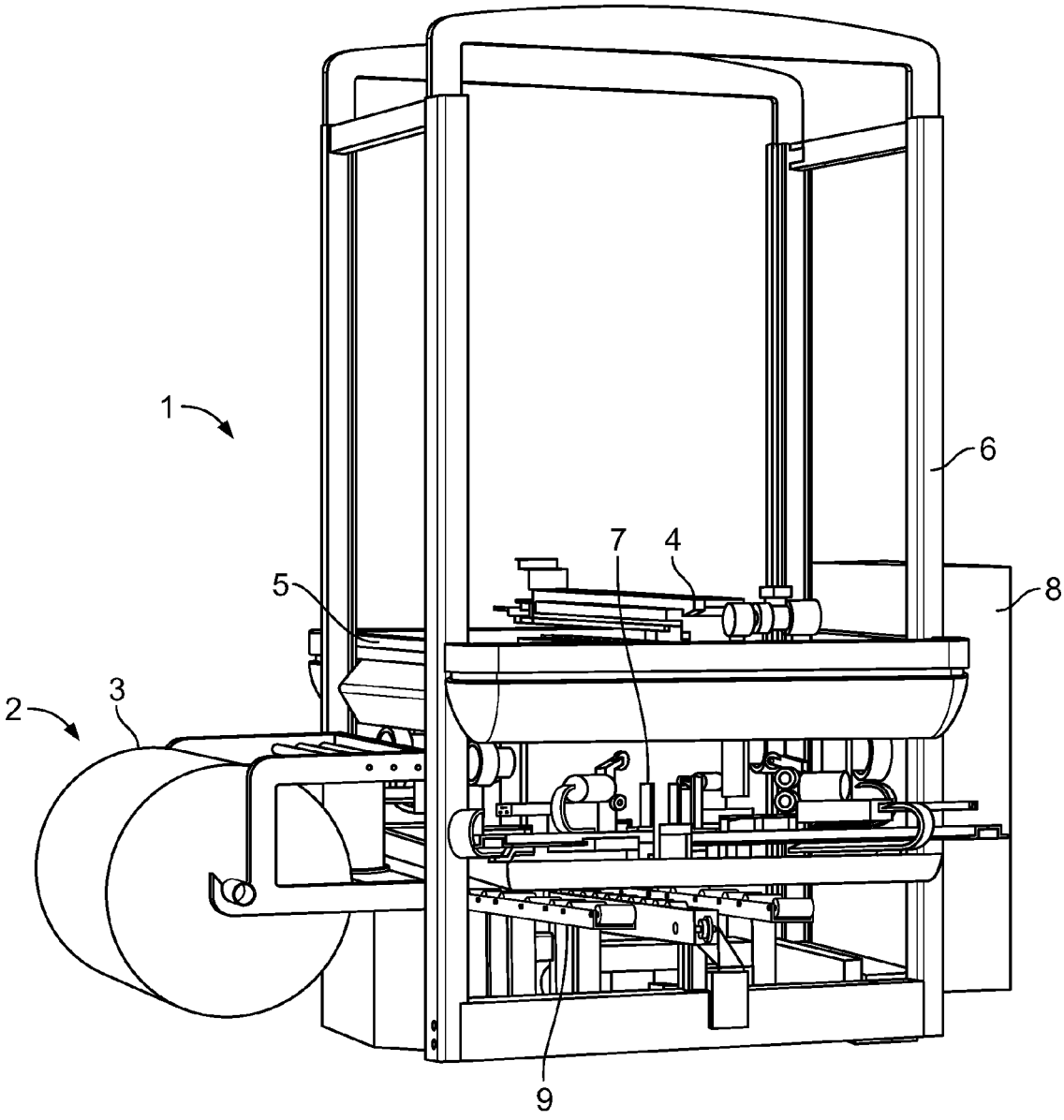
Figure 7:
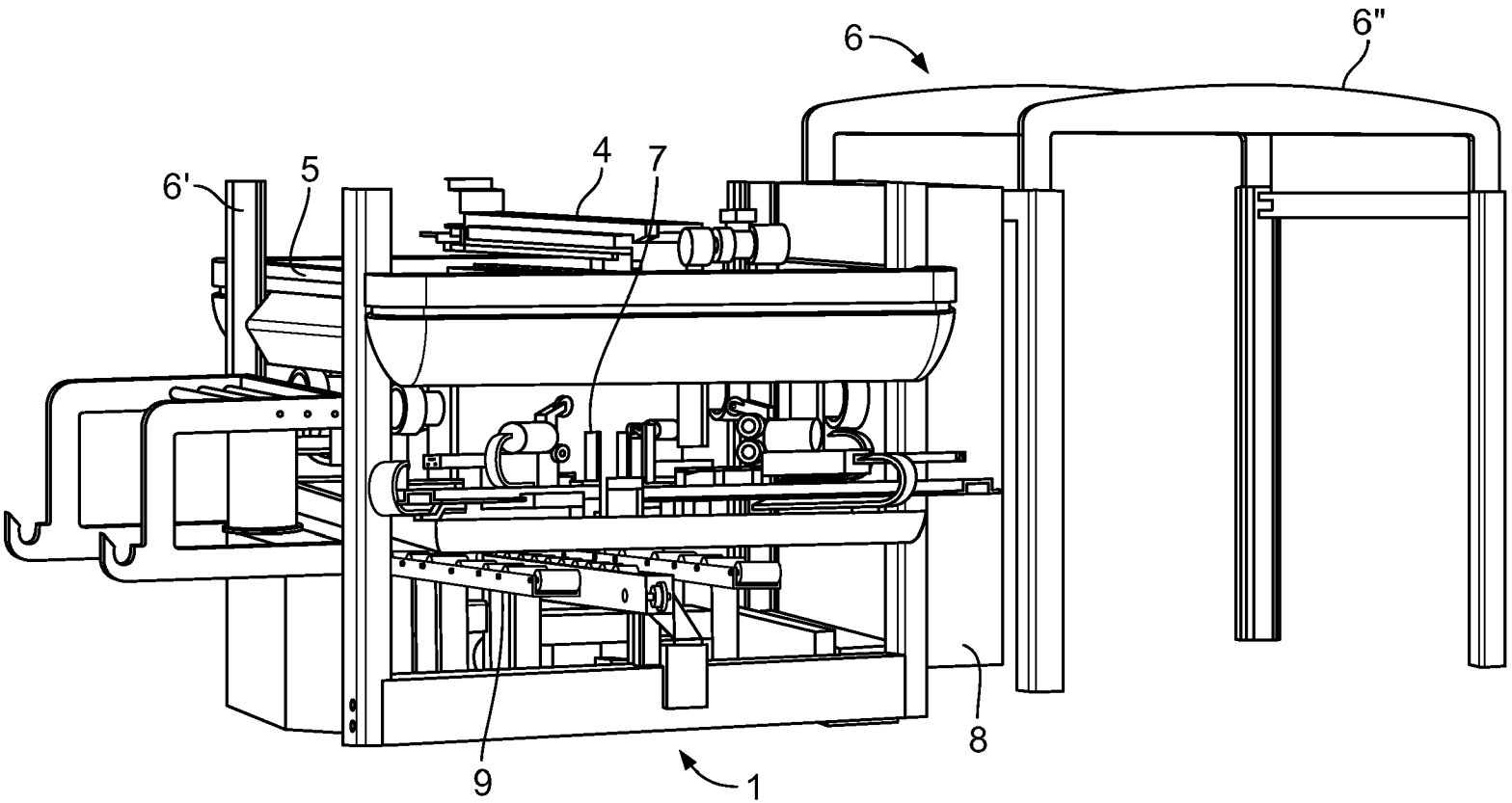
Figure 8B:
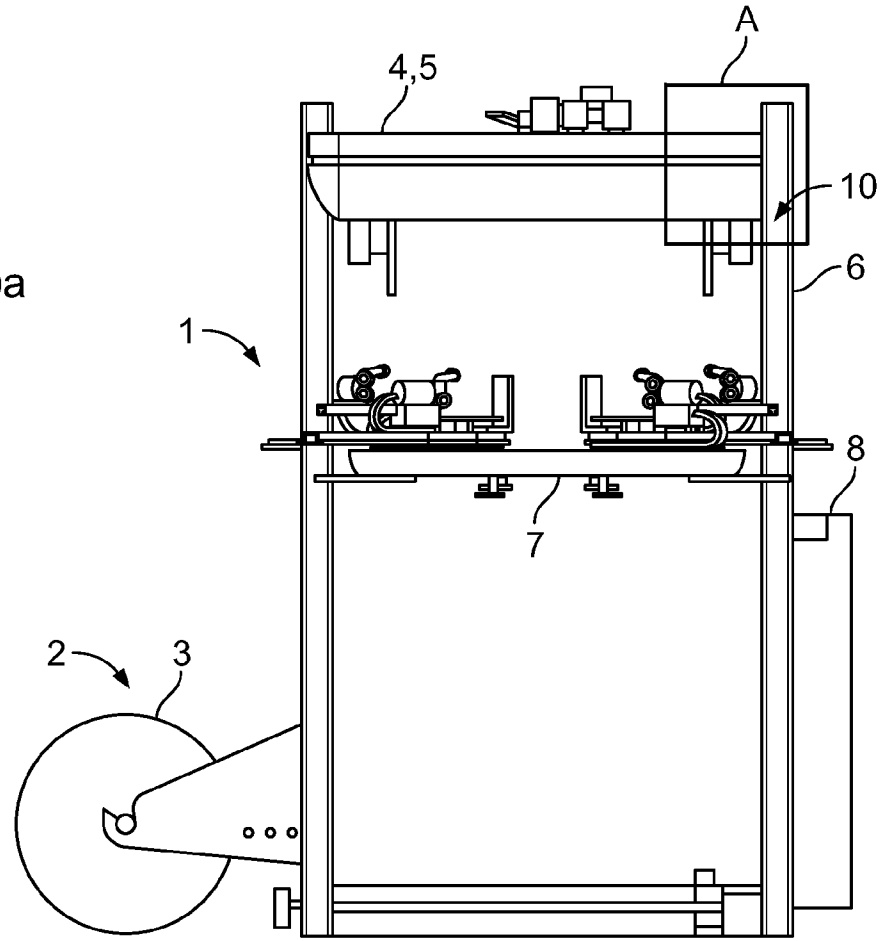
Figure 8A:
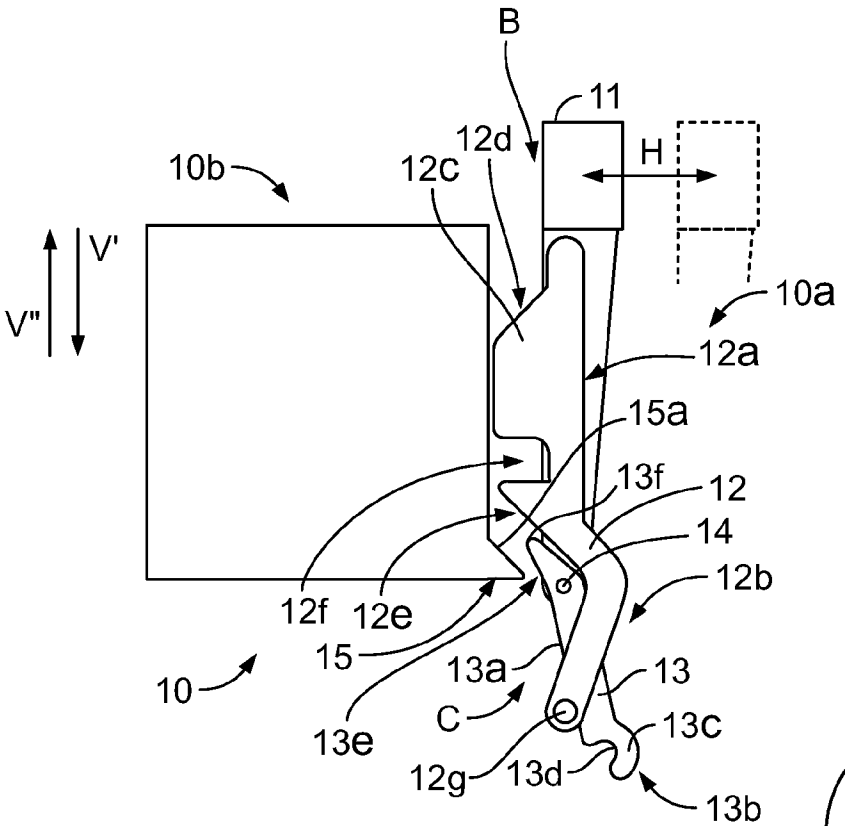

Additional advantages and properties of the present invention are shown in the following description of embodiment examples by way of drawings. They show:

FIG. 1 a total view of a wrapping device according to the invention;

FIG. 2 a total view of a wrapping device according to the invention with the film feeding device in a first operating position;

FIG. 3 the wrapping device of FIG. 2 with the film feeding device in a second operating position;

FIG. 4 the wrapping device of FIG. 2 and FIG. 3 with the covering device moved against the film feeding device;

FIG. 5 the wrapping device of FIG. 2 through 4 with the film feeding device moved downwards by the covering device;

FIG. 6 the wrapping device of FIG. 2 through 5 with a lowered film feeding device;

FIG. 7 a further embodiment of the wrapping device according to the invention with a removable upper segment of the device frame;

FIG. 8*a* a cross section of the detent mechanism of the invention in its operating position;

FIG. 8*b* a cross section of the wrapping device of the invention to locate the detent mechanism of FIG. 8*a;*

FIG. 9-19 further cross sections according to FIG. 8*a* to explain the functioning of the detent mechanism of the invention.

FIG. 1 shows a total view of a wrapping device 1 according to the invention for the wrapping of goods, specifically goods stacked on pallets or the like (not shown here). As is typical for such devices, the depicted wrapping device 1 is designed to wrap goods with a tube-like film. Thus, wrapping device 1 includes a film supply 2 in the form of a rolled tube-like film 3. In order to generate a domed film cover (not shown here) to package the listed goods, wrapping device 1 includes an essentially known film feeding device 4 with the fusion and cutting systems (not shown here) typical of such devices that separate and produce a cover from the film tube. In the design shown in FIG. 1, the film feeding device and its fusion and cutting systems (hereinafter referenced as "film feeding device" in short) are placed in frame 5 within device frame 6. Device frame 6 also contains an essentially known covering device 7 for the film cover below film feeding device 4. Covering device 7 can be moved up and down within device frame 6 in the direction of the vertical double arrow V. A console 8 is also shown.

A specialist skilled in the arts knows that the depicted wrapping device 1 operates by first drawing (unrolling) a tube-like film segment from film supply 2 via film supply device 4, fusing it to a domed film cover and cutting it above the fused bead by means of the fusion and cutting systems. The film cover thus produced is then grasped and opened by covering device 7, which has been elevated within device frame 6, and is then pulled downwards over the goods to be wrapped, which are not shown in FIG. 1. The latter are then removed from the interior of device frame 6, for example, by means of transport device 9, as shown in the following FIG. 2 to 7.

FIGS. 2 and 3 each show total views of a wrapping device that essentially corresponds to wrapping device 1 of FIG. 1. In contrast to FIG. 1, FIG. 2 as well as FIG. 3 also show in each case transport device 9 embodied as a roller transport device to insert or remove the goods. Furthermore, FIG. 2 depicts covering device 7 in a raised position compared to the view of FIG. 1, whereas it is shown in a different lower position in FIG. 3. In view of the movement of covering device 7 in the direction of double arrow V (FIG. 1), other positions of covering device 7 are also feasible.

FIG. 1 to 3 show wrapping device 1 of the invention with film feeding device 4 and correspondingly frame 5 in a (upper) operating position, as would be required in packaging a relatively high stack of goods, for example. However, in order to provide for easy access to film feeding device 4 for maintenance or repair work, for example, it may be lowered in the direction of arrow V' (FIG. 1) within device frame 6 into a lower maintenance position as will be explained in more detail below with reference to FIG. 4 to 7. Conversely, film feeding device 4 of the invention may later be returned to the depicted (raised) operating position in the direction of arrow V" (FIG. 1).

The invention permits other (lower) operating positions of the vertically movable film feeding device in addition to the depicted (raised) operating position, where the position may be determined by the height of the goods to be packaged or by an additional minimum distance to covering device 7 that must be observed for operating purposes.

As will be described below in more detail by reference to FIG. 8 to 19, the invention provides for at least one locking mechanism to lock movable film feeding device 4 or movable frame 5 containing the same in any desired operating position in device frame 6. The invention provides that this locking mechanism could be released or locked automatically by remote control in order to lock film feeding device 7 in an operating position or release it from the same.

FIGS. 4 and 5 show an embodiment of wrapping device 1 of the invention that is analogous to the depiction of FIGS. 2 and 3. As shown, film feeding device 4 and frame 5 in the depicted embodiment are only passively movable in a vertical direction within device frame 6, i.e. film feeding device 4 has no internal motor to power vertical movement up or down. Rather, film feeding device 4 or frame 5 are moved by covering device 7, which moves up and down in a vertical direction anyway and which has suitable means of propulsion. To accomplish this, as is shown in FIG. 4, covering device 7 pushes against film feeding device 4 from below, frees it from its (upper) operating position, and subsequently moves vertically downward within device frame 6 with film feeding device 4 in a kind of "piggy-back system" in the direction of the previously mentioned maintenance position. This is shown in FIG. 5.

Embodiments of the wrapping device of the invention are designed here such that the locking mechanism, which is not shown in FIG. 1 to 5 and which is intended to lock film feeding device 4 in the (raised) operating position, includes a detent mechanism to be explained in more detail below (see FIGS. 8*a* and 9-19), by which film feeding device 4 is locked into the appropriate operating position, on the one hand, and which is triggered by the previously specified movement of covering device 7 through contact with film feeding device 4—as shown in FIG. 5.

FIG. 6 shows film feeding device 4 with frame 5 in the lower maintenance position, in which it is immediately accessible "at ground level" for the operating staff of wrapping device 1 of the invention. It is also possible to include a detent mechanism of the type to be discussed below to lock film feeding device 4 in the maintenance position. As an alternative, a simple detent or the like on device frame 6 could be provided to lock film feeding device 4 in the maintenance position.

However, as an alternative to the embodiment of the wrapping device of the invention described above, it is also feasible to provide for a suitable motor in direct connection to film feeding device 4 in order to move film feeding device 4 within device frame 6 independently of covering device 7.

FIG. 7 shows another advantageous embodiment of wrapping device 1 of the invention. Device frame 6 consists here of at least two parts, thus a lower device frame 6' and an upper device frame 6", where upper device frame 6" can be removed from lower device frame 6'. In addition to more compact space requirement for transport of the device, such an embodiment also facilitates easier access during maintenance work, i.e. specifically when film feeding device 4 is located in the lower maintenance position, as depicted. In addition, it simplifies installation of the vertically movable components of the device, specifically film feeding device 4 with the fusion and cutting systems as well as covering device 7, which may be installed easily "at ground level" in the embodiment shown in FIG. 7 and then moved to their respective operating positions after upper device frame 6" is mounted on lower device frame 6'.

The following Figures present explanations of the locking mechanism or the detent mechanism included in the embodiments of the wrapping device of the invention described above to lock the film feeding device into position in a controlled manner. Specifically, each operating position of film feeding device 4 requires at least one such locking mechanism or detent mechanism at each level.

FIG. 8*a* shows a cross section of detent mechanism 10 of the invention to lock film feeding device 4 with its fusion and cutting systems, which moves vertically within device frame 6, into vertical position (FIG. 1-7).

FIG. 8*b* identifies moreover the specific arrangement of the detent mechanism for the embodiment depicted in FIG. 8*a* by means of a cross section of wrapping device 1 of the invention. As shown in FIG. 8*b*, the mechanism is located in the quadratic area marked as A with reference number 10.

Detent mechanism 10 of the invention shown in FIG. 8*a* consists generally of a component 10*a* linked to device frame 6 (FIG. 8*b*) and a component 10*b* linked to film feeding device 4 or frame 5. In other words: Component 10*b* of detent mechanism 10 of the invention is either part of film feeding device 4 or of a separate frame 5, which surrounds the same, where the presence of such a frame is not a required characteristic of the present invention—as indicated above. Film feeding device 4 may thus either move on its own or within frame 5 within device frame 6 of wrapping device 1. The present embodiment of the invention assumes, for example, that component 10*b* is a structural element that forms one side of frame 5.

Component 10*a* of detent mechanism 10 of the invention is linked to device frame 6 of the wrapping device 1 of the invention (FIG. 8*b*) and is locked into position on device frame 6 in at least one operating position of detent mechanism 10. To accomplish this, detent mechanism 10 has a linkage element 11, which in a particular embodiment of detent mechanism 10 of the invention can be moved horizontally in the direction of double arrow H between the operating position shown in FIG. 8*a* and a stand-by position indicated by hatched lines, as will be discussed in more detail below.

Toggle lever 12 is linked to linkage element 11 at B, where the toggle lever rotates around a rotation axis that is perpendicular to the plane of the view, but that is not shown here. Toggle lever 12 has an essentially straight first segment or arm 12*a* and an obtuse-angled bent second segment or arm 12*b*. The first segment 12*a* of toggle lever 12 is rotationally linked to linkage element 11, as stated above. The first segment 12*a* of the inner side of toggle lever 12 facing component 10*b* supports a protuberance 12*c*, where the sides of the protuberance are embodied as sloping ramps 12*d*, 12*e* leading in the direction towards protuberance 12*c*, such that the cross section of protuberance 12*c* has a trapezoidal shape. Toggle lever 12 has a recess 12*f* within protuberance 12*c*.

Toggle lever 12 is affixed to device frame 6 of wrapping device 1 (FIG. 8*b*) or to linkage element 11 such that its knee, i.e. the point or apex of angled segment 12*b* points to the outside, i.e. away from component 10*b* of detent mechanism 10. A contact element 12*g* consisting of a stud perpendicular to the plane of the view and extending through the same is included on the free end of toggle lever 12, i.e. on the free end of second segment 12*b*.

Contact element 12*g* links the toggle lever to another rotating lever 13 also included in component 10*a* of detent mechanism 10. Rotating lever 13 is linked to linkage element 11 such that it rotates at C around rotation axis 14, which is parallel to the rotation axis of toggle lever 12. Linkage element 11 and/or the second segment 12*b* of toggle lever 12 are shaped such that the second segment 12*b* of toggle lever 12 reaches around rotating lever 13 as shown and links to the inner or lower face 13*a* of rotating lever 13 via contact element 12*g*. At its first end 13*b*, rotating lever 13 has a bent hook-like extension 13*c*, which is formed by a U-shaped notch 13*d* that opens to the inner face 13*a* of rotating lever 13. Rotating lever 13 extends beyond its rotation axis 14 with extension 13*f* at its second end 13*e*.

In the depiction in FIG. 8*a*, toggle lever 12 and rotating lever 13 are in their initial or base positions, to which they will return solely due to gravity and their weights, given their rotating linkage to linkage element 11. Moreover, it is also possible to add suitable tensioning devices (not shown here) on toggle lever 12 to ensure that toggle lever 12 will normally be in the position shown in FIG. 8*a* with an essentially vertical orientation, i.e. an orientation parallel to device frame 6 of wrapping device 1 (FIG. 8*b*). The aforementioned tensioning devices may include springs, but hydraulic or pneumatic systems may also be used to tension the toggle lever.

In order to actuate detent mechanism 10, component 10*b*, i.e. either on film feeding device 4 or on frame 5 of wrapping device 1, has a detent protuberance 15 as shown in FIG. 8*a* with ramp 15*a* on its top surface and which links in various ways with the corresponding ends of toggle lever 12 or rotating lever 13 to actuate detent mechanism 10 when component 10*b* is moved vertically up or down in the direction of arrows V' and V", i.e. to raise or lower film feeding device 4 in the wrapping device of the invention, as described above. This is shown in more detail below in FIG. 9 to 19.

Figure 9:
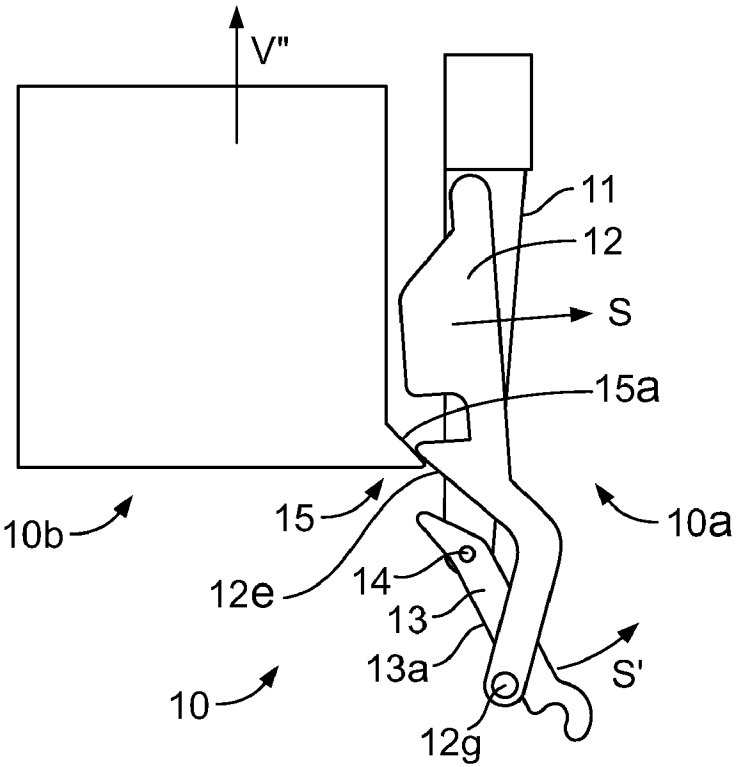

FIG. 9 shows how detent protuberance 15 with its ramp 15*a* makes contact with the matching ramp 12*e* of toggle lever 12 when component 10*b* is moved upwards in the direction V", which triggers a counterclockwise rotation S of toggle lever 12. In other words: toggle lever 12 rotates to the outside until detent protuberance 15 snaps into detent notch 12*f* of toggle lever 12 with additional upward movement V" of component 10*b*. This position is shown in FIG. 10.

FIG. 9 also shows that rotation S of toggle lever 12 around stud 12*g*, which is in contact with the lower side 13*a* of rotating lever 13, also rotates rotating lever 13 counterclockwise around its axis 14 towards the outside (arrow S' in FIG. 9).

Figure 10:
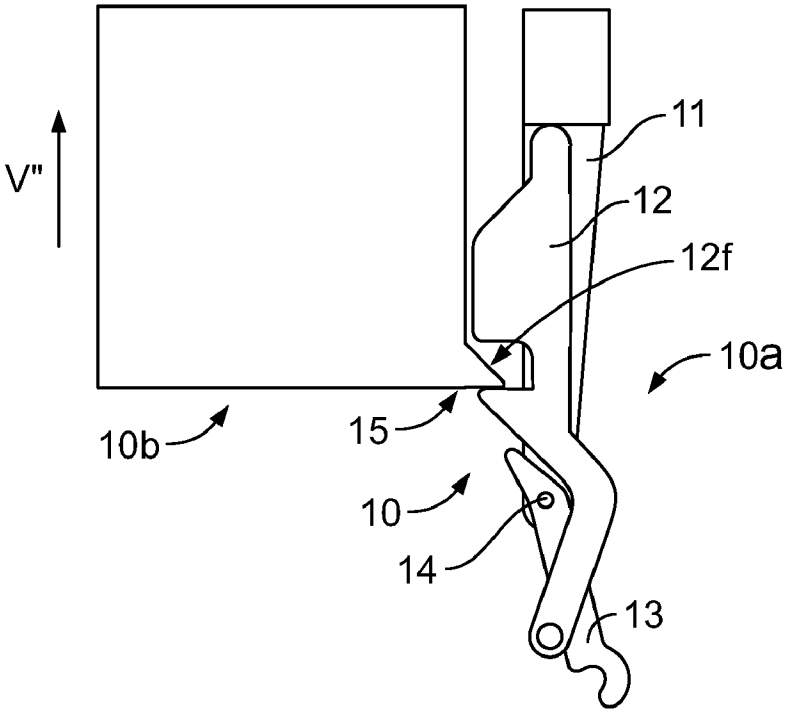

As mentioned above, ramps 12*e* and 15*a* will slide on each other, while toggle lever 12 pivots to the outside far enough to let detent protuberance 15 of component 10*b* eventually slide past ramp 12*e* of toggle lever 12 and drop into detent notch 12*f* of toggle lever 12 (FIG. 10).

Thus, the view of FIG. 10 shows a rest position of detent mechanism 10 of the invention and component 10*b*, i.e. film feeding device 4 or frame 5 of the wrapping device 1 of the invention (FIG. 8*b*), has snapped beyond detent protuberance 15 into a particular rest position and is locked into place relative to a vertical downward motion, such that covering device 7 (FIG. 8*b*) used to move film feeding device 4 may also be moved into its operating position in this embodiment of the invention.

As FIG. 10 also shows, toggle lever 12 and rotating lever 13 are also returned to their respective starting positions shown in FIG. 8*a* by the tensioning devices mentioned above.

Figure 11:
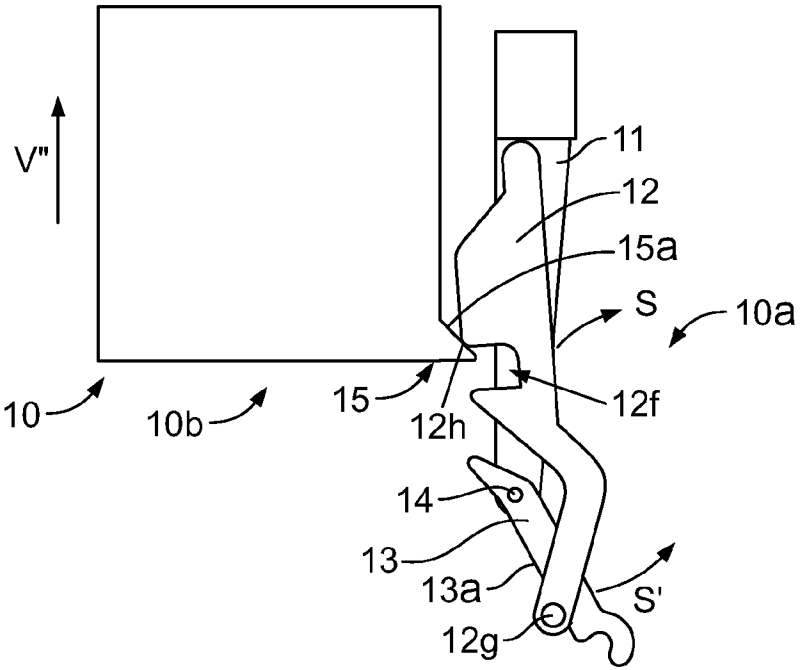

To release the detent mechanism of the invention, covering device 7 is again lifted up against film feeding device 4 or frame 5 (FIG. 8*b*) from below, until it makes contact with the same and is then moved higher vertically, as is shown in FIG. 11. In this process, ramp 15*a* of detent protuberance 15 on component 10*b* makes contact with an upper corner 12*h* of detent notch 12*f* of toggle lever 12, where corner 12*h* again slides on ramp 15*a* to generate a counterclockwise rotating movement S of toggle lever 12. Stud 12*g* in turn also rotates rotating lever 13 in a clockwise direction (arrow S' in FIG. 11).

Figure 12:
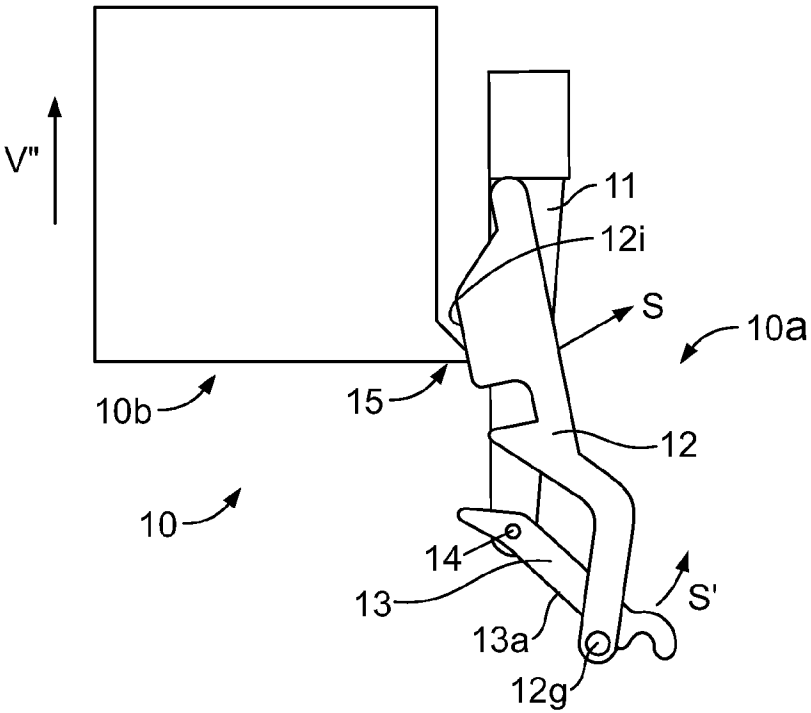

As FIG. 12 shows, these rotating movements S, S' continue while detent protuberance 15 slides upwards along a vertical inner slide surface 12*i* of toggle lever 12 above corner 12*h*.

Figure 13:
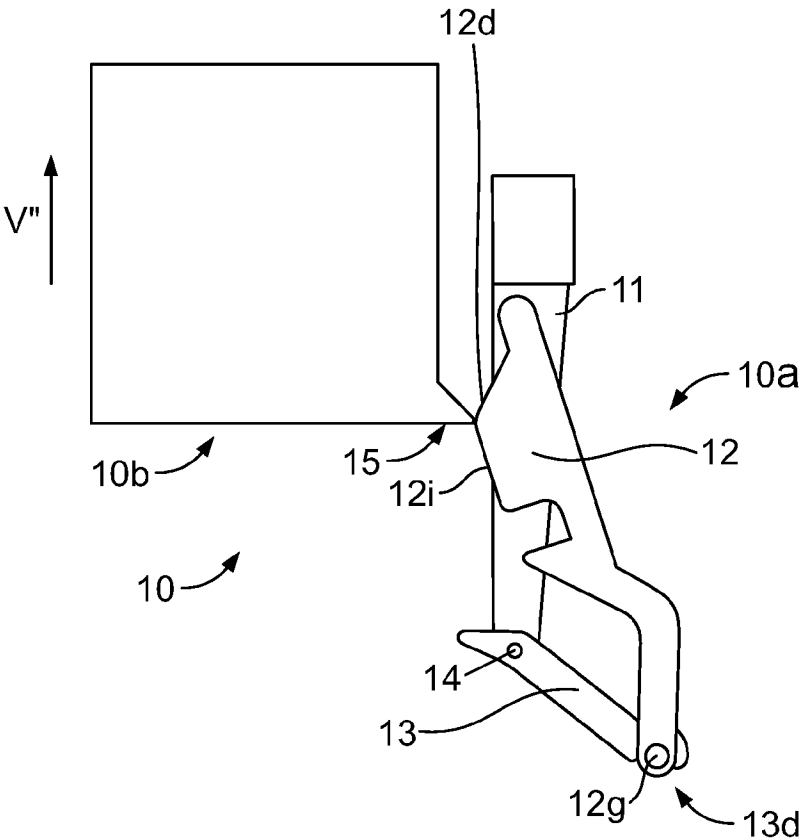

Toggle lever 12 and rotating lever 13 reach their maximum extension towards the outside, when the highest point of vertical slide surface 12*i* is reached at the transition to ramp 12*d* of toggle lever 12, as is shown in FIG. 13. Stud 12*g* on toggle lever 12 then slips into the corresponding notch 13*d* of rotating lever 13 and is held there tightly. By means of this tight grip, rotating lever 13 locks toggle lever 12 in its maximum extension position, as is shown in FIG. 13. Film feeding device 4 or frame 5, i.e. component 10*b*, may move upwards for a short additional distance (arrow V") before the intended downwards vertical movement V' commences.

Figure 14:
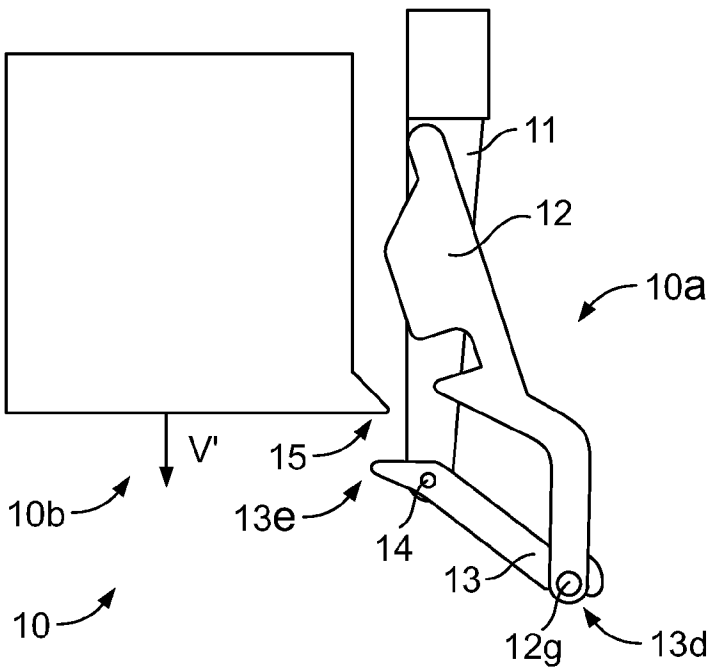

As FIG. 14 shows, component 10*b* with its detent protuberance 15 moves vertically down-wards in the direction of arrow V' past toggle lever 12 in its maximum outward extension. Toggle lever 12 and rotating lever 13 remain in their respective maximum extended position, because stud 12*g* continues to be firmly lodged in notch 13*d* of rotating lever 13.

Figure 15:
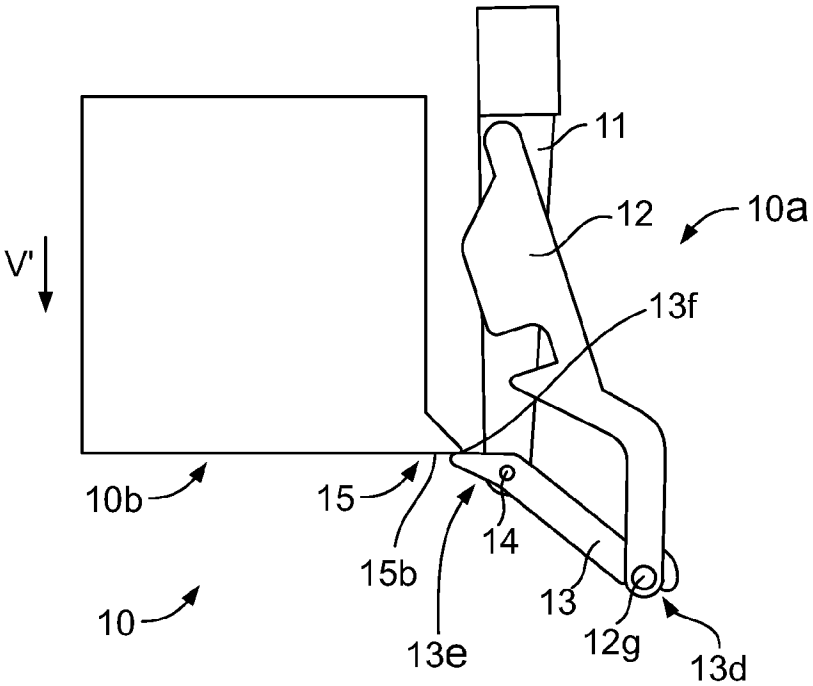

Once component 10*b* or its detent protuberance 15 has moved downwards a certain distance, a horizontal border 15*b* of detent protuberance 15 makes contact with extension 13*f* at end 13*e* of rotating lever 13. This is depicted in FIG. 15.

Figure 16:
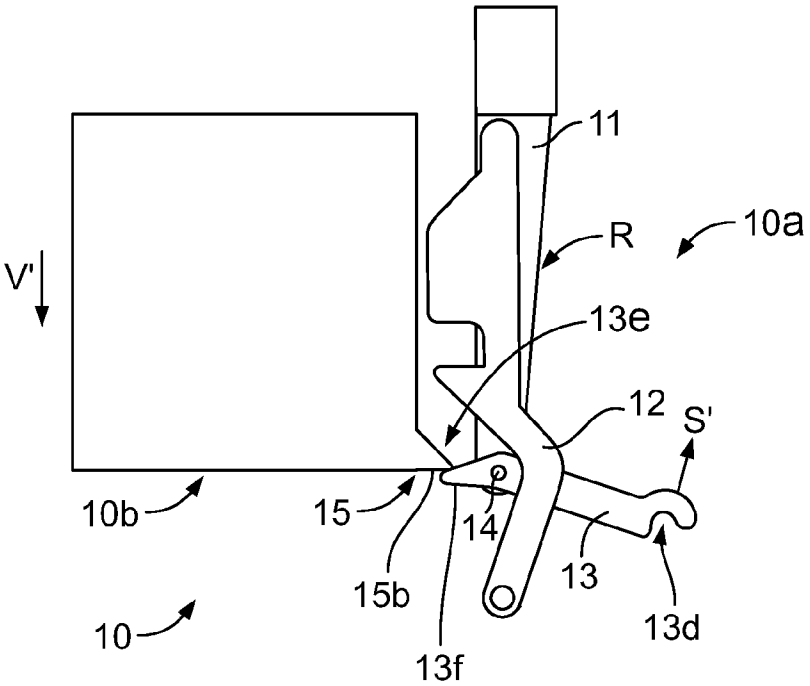

As shown in FIG. 16, the contact described above between the horizontal border 15*b* of detent protuberance 15 and extension 13*f* of rotating lever 13 causes a counterclockwise rotation S' of rotating lever 13, where stud 12*g* will slip out of notch 13*d* of rotating lever 13 at a certain point, such that toggle lever 12 will rotate back into its original position in the direction of arrow R due to its own weight and/or the tension discussed above (see FIG. 8*a*).

Figure 17:
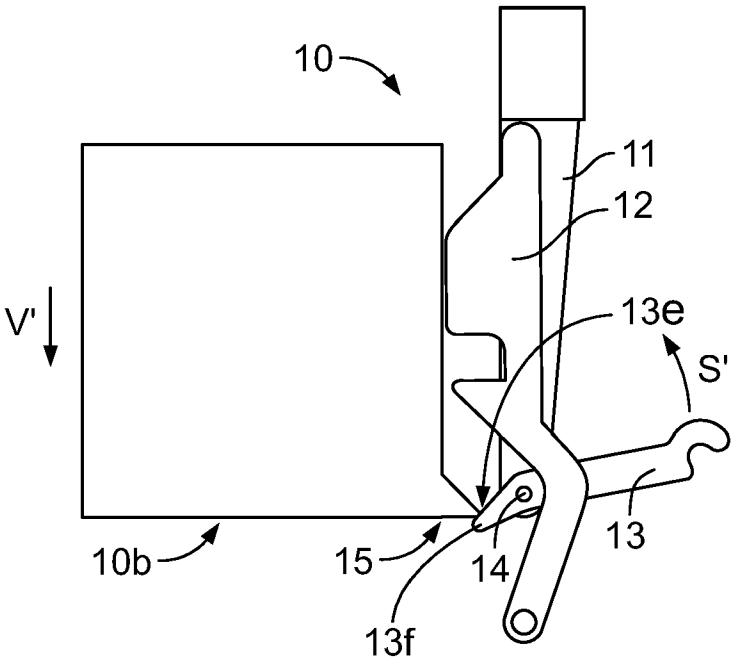

As shown in FIG. 17, component 10*b* continues to move vertically downwards in direction V', which continues the clockwise rotation S' of rotation lever 13. Rotation S' of rotating lever 13 ends when detent protuberance 15 no longer makes contact with extension 13*f* at the end 13*e* of rotating lever 13.

Figure 18:
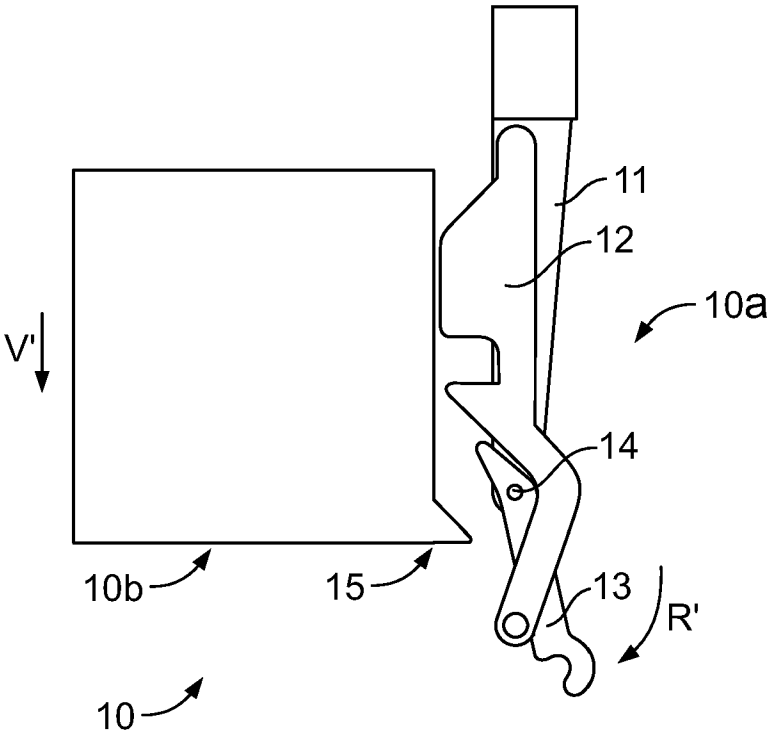

Once this has happened, rotating lever 13 is released, as is shown in FIG. 18, and rotates clockwise back into its original position shown in FIG. 8*a* due to its weight (arrow R' in FIG. 18). Component 10*b* has thus lost all contact with detent mechanism 10 and is lowered further.

Figure 19:
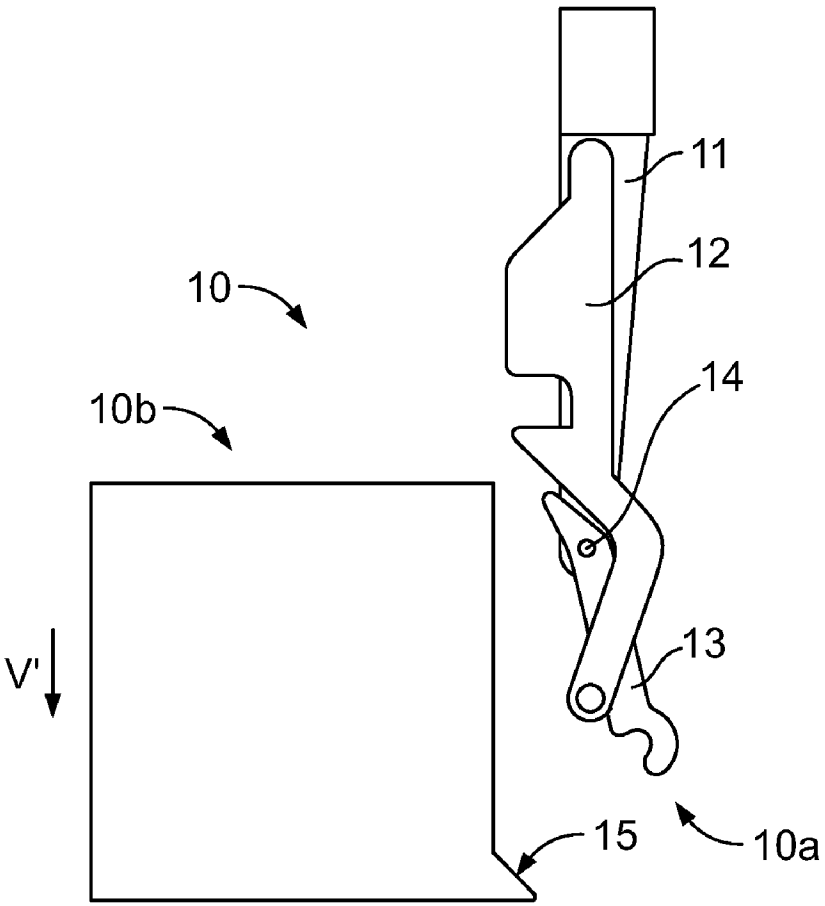

This is shown once more explicitly in FIG. 19. Here the respective positions of toggle lever 12 and rotating lever 13 again match the original positions shown in FIG. 8*a*, and the detent mechanism 10 is reset.

As discussed above with respect to FIG. 8*a*, the horizontal movement H of detent mechanism 10, i.e. of linkage element 11 with toggle lever 12 and rotation lever 13, plus tensioning devices, if applicable, into a so-called standby position is intended to ensure that device frame 6 (FIG. 8*b*) can be traversed flawlessly between at least one (raised) operating position and one lower maintenance position with the assistance of film feeding device 4. This is particularly important, if there are additional locking positions with appropriate detent mechanisms for film feeding device 4 or frame 5 between the two positions listed above. However, the above description indicates that such a horizontal movement H of the detent mechanism into a standby position is not necessarily required, given that detent mechanism 10 can be traversed in both directions, if there is no intention to lock it. However, given that such movement past detent mechanism 10 in its operating position will cause a certain amount of wear and tear of detent protuberance 15, the aforementioned horizontal movement of the detent mechanism between its operating position and its standby position (see FIG. 8*a*) may be shown to be advantageous.

As mentioned above, the inclusion of various detent mechanisms 10 at various heights on device frame 6 in an advantageous embodiment of wrapping device 1 of the invention will facilitate locking film feeding device 4 with the fusion and cutting systems in various heights as desired.

Of course, it is feasible in all embodiments of the present invention to control the complete movement of detent mechanism 10 between its operating position and its stand-by position by remote control. In that process, the detent mechanism may in turn be powered by springs, hydraulic means or pneumatic means or, as an alternative, by the use of electric motors.

The invention claimed is:

1. A detent mechanism in a wrapping device, the detent mechanism configured for locking a film feeding device having fusion and cutting systems, the fusion and cutting systems moveable vertically within a device frame, into a vertically locked position, the detent mechanism comprising: a toggle lever that rotates around a first rotation axis perpendicular to a vertical direction of movement of the film feeding device, the detent mechanism further including an inner detent notch on the toggle lever facing the film feeding device, wherein a ramp segment of the toggle lever is shaped to match a complementary latch on the film feeding device, such that a vertical rising movement of the film feeding device causes the toggle lever to rotate away from the film feeding device, until the complementary latch snaps into the inner detent notch on the toggle lever to lock the film feeding device into a detent position relative to a downward movement.

2. The detent mechanism in accordance with of claim 1, including a tension device on the toggle lever for tensioning the toggle lever in a direction oriented towards the film feeding device.

3. The detent mechanism in accordance with claim 1, including a linkage element to link a free end of the toggle lever opposite the first rotation axis to a rotating lever, the rotating lever rotates around a second rotation axis parallel to the first rotation axis, such that movement of the toggle lever causes movement of the rotating lever, and wherein the rotating lever has a rotating lever notch formed therein such that vertical movement of the film feeding device, beyond the detent position pushes a stud on the toggle lever into the rotating lever notch, and wherein the rotating lever blocks the toggle lever in a maximum rotation position, to permit free vertical movement of the film feeding device.

4. The detent mechanism in accordance with claim 3, including a projection on the rotating lever facing the film feeding device in the maximum rotation position of the toggle lever relative to the second rotation axis, wherein downward movement of the film feeding device beyond the detent position causes the complementary latch to make contact with the projection on the rotating lever to rotate the rotating lever and release the stud on the toggle lever from the notch on the rotating lever.

5. The detent mechanism in accordance with claim 1, including at least one component of the detent mechanism that moves horizontally between a first inner operating position and an outer stand-by position, wherein there is no interaction in the outer stand-by position between the complementary latch and the toggle lever during vertical movement of the film feeding device.

6. A method for operating a wrapping device for packaging goods stacked on pallets, with a tube-like film, the wrapping device including a film feeding device with fusion and cutting systems to generate and feed a dome-like film cover within a device frame, the film feeding device working in conjunction with a covering device that moves vertically up and down within the device frame, the covering device configured to grasp the film cover and extend the film cover to cover the goods positioned in a lower segment of the device frame, a detent mechanism configured for locking the film feeding device having the fusion and cutting systems, the fusion and cutting systems moveable vertically within the device frame, into a vertically locked position, the detent mechanism having a toggle lever that rotates around a first rotation axis perpendicular to a vertical direction of movement of the film feeding device, the detent mechanism further including an inner detent notch on the toggle lever facing the film feeding device, wherein a ramp segment of the toggle lever is shaped to match a complementary latch on the film feeding device, such that a vertical rising movement of the film feeding device causes the toggle lever to rotate away from the film feeding device, until the complementary latch snaps into the inner detent notch on the toggle lever to lock the film feeding device into a detent position relative to a downward movement, the method comprising:

moving the film feeding device vertically within the device frame into a raised operating position for packaging the goods;

locking the film feeding device into the raised operating position by using the detent mechanism; and lowering the film feeding device within the device frame into a lower position to permit access to the film feeding device.

7. The method for operating a wrapping device in accordance with claim 6, wherein the film feeding device is moved by vertical movement of the covering device.

* * * * *